US010792912B2

(12) United States Patent
Maeyama et al.

(10) Patent No.: US 10,792,912 B2
(45) Date of Patent: Oct. 6, 2020

(54) LIQUID DISCHARGE APPARATUS

(71) Applicants: Yuichiro Maeyama, Kanagawa (JP); Yasuyuki Horie, Kanagawa (JP)

(72) Inventors: Yuichiro Maeyama, Kanagawa (JP); Yasuyuki Horie, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/294,405

(22) Filed: Mar. 6, 2019

(65) Prior Publication Data

US 2019/0283398 A1 Sep. 19, 2019

(30) Foreign Application Priority Data

Mar. 15, 2018 (JP) ..... 2018-047564

(51) Int. Cl.

| | |
|---|---|
| ***B41J 11/00*** | (2006.01) |
| ***B41J 2/01*** | (2006.01) |
| ***B41J 11/42*** | (2006.01) |
| ***B41J 13/22*** | (2006.01) |

(52) U.S. Cl.

CPC ..... *B41J 2/01* (2013.01); *B41J 11/008* (2013.01); *B41J 11/0045* (2013.01); *B41J 11/0095* (2013.01); *B41J 11/42* (2013.01); *B41J 13/223* (2013.01)

(58) Field of Classification Search

CPC . B41J 2/01; B41J 11/008; B41J 13/223; B41J 11/0095; B41J 11/0045; B41J 11/42

See application file for complete search history.

(56) References Cited

U.S. PATENT DOCUMENTS

| | | | | |
|---|---|---|---|---|
| 5,815,174 | A * | 9/1998 | Stone | B41J 29/393 347/19 |
| 7,914,099 | B2 * | 3/2011 | Loh | B41J 11/0095 347/16 |
| 2002/0126193 | A1 * | 9/2002 | Maki | B41J 11/007 347/104 |
| 2012/0163892 | A1 * | 6/2012 | Katahira | B41J 11/42 400/76 |

(Continued)

FOREIGN PATENT DOCUMENTS

| | | |
|---|---|---|
| JP | 2006-347045 | 12/2006 |
| JP | 2007-105969 | 4/2007 |

(Continued)

*Primary Examiner* — Sharon A. Polk
(74) *Attorney, Agent, or Firm* — Duft & Bornsen, PC

(57) ABSTRACT

A liquid discharge apparatus includes a rotator, a liquid discharger, a sheet-material position detector, a first signal output device, a second signal output device, and circuitry. The rotator carries a sheet material on a circumferential surface and conveys the sheet material. The liquid discharger discharges liquid onto the sheet material. The sheet-material position detector detects a position of the sheet material. The first signal output device outputs a first signal corresponding to a rotation amount of the rotator. The second signal output device outputs a second signal correlated with a movement amount of the sheet material on the circumferential surface of the rotator. The circuitry determines a discharge start timing of the liquid discharger from a detection result of the sheet-material position detector and the first signal, and generates a discharge timing of the liquid discharger from the second signal.

20 Claims, 7 Drawing Sheets

(56) References Cited

U.S. PATENT DOCUMENTS

| | | | | |
|---|---|---|---|---|
| 2014/0079461 | A1* | 3/2014 | Obata | B41J 15/04<br>400/635 |
| 2015/0077457 | A1* | 3/2015 | Nakada | B41J 11/42<br>347/16 |

FOREIGN PATENT DOCUMENTS

| | | |
|---|---|---|
| JP | 2008-162274 | 7/2008 |
| JP | 2013-123826 | 6/2013 |
| JP | 2014-128932 | 7/2014 |

* cited by examiner

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-047564, filed on Mar. 15, 2018, in the Japan Patent Office, the entire disclosure of which is hereby incorporated by reference herein.

BACKGROUND

Technical Field

The present invention relates to a printing apparatus.

Related Art

As a liquid discharge apparatus, for example, there is an apparatus that performs printing while carrying a sheet material on a rotator such as a conveying drum and conveying the sheet material.

There is a known conventional apparatus that includes a linear encoder including an encoder scale attached to a conveying belt, and a rotary encoder including an encoder wheel provided on a shaft of a roller around which the conveying belt is stretched, and controls the feeding speed of the conveying belt while correcting a detection result of the rotary encoder on the basis of a detection result of the linear encoder.

SUMMARY

In an aspect of the present disclosure, there is provided a liquid discharge apparatus that includes a rotator, a liquid discharger, a sheet-material position detector, a first signal output device, a second signal output device, and circuitry. The rotator carries a sheet material on a circumferential surface and conveys the sheet material. The liquid discharger discharges liquid onto the sheet material. The sheet-material position detector detects a position of the sheet material. The first signal output device outputs a first signal corresponding to a rotation amount of the rotator. The second signal output device outputs a second signal correlated with a movement amount of the sheet material on the circumferential surface of the rotator. The circuitry determines a discharge start timing of the liquid discharger from a detection result of the sheet-material position detector and the first signal, and generates a discharge timing of the liquid discharger from the second signal.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
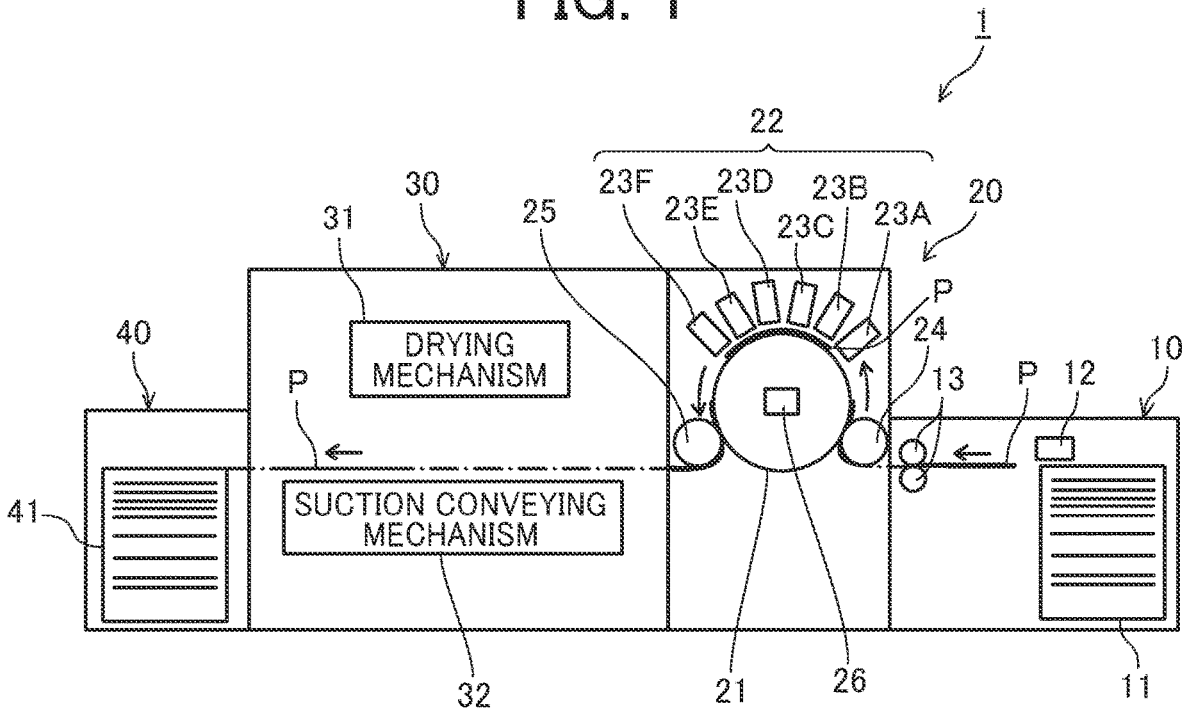
FIG. 1 is a schematic explanatory view of a printing apparatus as a liquid discharge apparatus according to a first embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Figure 2:
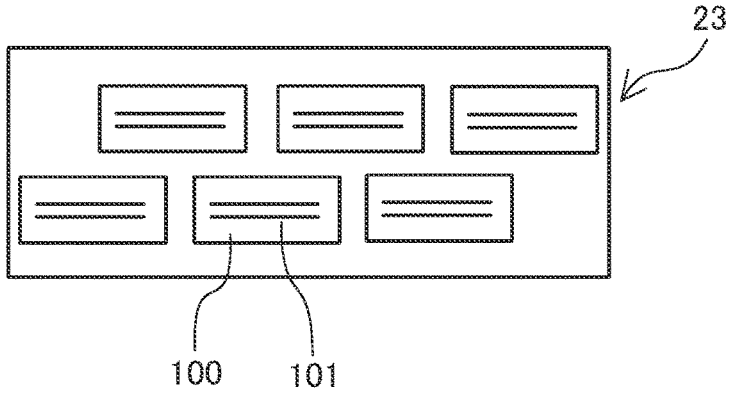
FIG. 2 is a plan explanatory view of a discharge unit of the printing apparatus.

Embodiments of the present invention will be described below with reference to the accompanying drawings. First, a first embodiment of the present invention will be described referring to FIGS. 1 and 2. FIG. 1 is a schematic explanatory view of a printing apparatus as a liquid discharge apparatus according to the first embodiment, and FIG. 2 is a plan explanatory view of a discharge unit of the printing apparatus.

A printing apparatus 1 includes a loader 10, a printer 20, a drier 30, and an unloader 40. The printing apparatus 1 applies liquid to a sheet material P which is a sheet-like member to be loaded in from the loader 10 in the printer 20 to perform required printing, dries the liquid adhering to the sheet material P in the drier 30, and then discharges the sheet material P to the unloader 40.

The loader 10 includes a loading tray 11 on which a plurality of sheet materials P is stacked, a feeding device 12 to separate and feed out the sheet materials P one by one from the loading tray 11, and a pair of registration rollers 13 to feed the sheet material P to the printer 20.

As the feeding device 12, any feeding device may be used such as a device using rollers, or a device using air suction. After a tip end of the sheet material P fed from the loading tray 11 by the feeding device 12 reaches the pair of registration rollers 13, the pair of registration rollers 13 is driven at a predetermined timing so that the sheet material P is fed to the printer 20.

The printer 20 includes: a conveying drum 21 serving as conveying means to carry the sheet material P on the outer circumferential surface and convey the sheet material P; and a liquid discharge device 22 to discharge liquid toward the sheet material P carried on the conveying drum 21.

The printer 20 further includes: a transfer cylinder 24 to receive the fed sheet material P and transfer the sheet material P to the conveying drum 21; and a delivery cylinder 25 to deliver the sheet material P conveyed by the conveying drum 21 to the drier 30.

The tip end of the sheet material P conveyed from the loader 10 to the printer 20 is gripped by a sheet gripper provided on the surface of the transfer cylinder 24, and the sheet material P is conveyed in accordance with the rotation of the transfer cylinder 24. The sheet material P conveyed by the transfer cylinder 24 is delivered to the conveying drum 21 at a position facing the conveying drum 21.

A sheet gripper is also provided on the surface of the conveying drum 21, and the tip end of the sheet material P is gripped by the sheet gripper. A plurality of suction holes is dispersedly formed on the surface of the conveying drum 21. A suction airflow directed inward from the suction holes of the conveying drum 21 is generated by an attraction device 26 that is an attraction means.

The tip end of the sheet material P delivered from the transfer cylinder 24 to the conveying drum 21 is gripped by the sheet gripper, and attracted onto the conveying drum 21 by the suction airflow by the attraction device 26, and the sheet material P is conveyed in accordance with the rotation of the conveying drum 21.

The liquid discharge device 22 includes discharge units 23 (23A to 23F) that are liquid discharger. For example, the discharge unit 23A discharges liquid of cyan (C), the discharge unit 23B discharges liquid of magenta (M), the discharge unit 23C discharges liquid of yellow (Y), and the discharge unit 23D discharges liquid of black (K). The discharge units 23F and 23F are used for discharging special liquid such as any of YMCK, white, or gold (silver). It is also possible to provide a discharge unit to discharge treatment liquid such as surface coat liquid.

As illustrated in FIG. 2, the discharge unit 23 is, for example, a full line type head in which a plurality of liquid discharge heads 100 (hereinafter, simply referred to as "heads") is arranged in a base member 52, the liquid discharge heads 100 each having a nozzle row 101 in which a plurality of nozzles is arrayed.

The discharge operation of each discharge unit 23 of the liquid discharge device 22 is controlled by a drive signal corresponding to print information. When the sheet material P carried on the conveying drum passes through a region facing the liquid discharge device 22, liquid of each color is discharged from the discharge units 23, and an image corresponding to the printing information is printed.

The drier 30 includes a drying mechanism 31 to dry the liquid adhering to the sheet material P in the printer 20, and a suction conveying mechanism 32 to convey (suck and convey) the sheet material P conveyed from the printer 20 in a suctioned state.

The sheet material P conveyed from the printer 20 is received by the suction conveying mechanism 32, and then conveyed so as to pass through the drying mechanism 31 to be delivered to the unloader 40.

When passing through the drying mechanism 31, the liquid on the sheet material P is subjected to drying treatment. As a result, the liquid component such as moisture in the liquid evaporates, the colorant contained in the liquid is fixed on the sheet material P, and curl of the sheet material P is suppressed.

The unloader 40 includes an unloading tray 41 on which a plurality of sheet materials P is stacked. The sheet material P conveyed from the drier 30 is sequentially stacked and held on the unloading tray 41.

In the printing apparatus 1, for example, a pre-processing device that performs pre-processing for the sheet material P may be arranged on the upstream side of the printer 20, or a post-processing device that performs post-processing for the sheet material P to which the liquid has adhered may be arranged between the drier 30 and the unloader 40.

Examples of the pre-processing device include a device that performs pre-coat processing in which treatment liquid for reacting with liquid to suppress bleeding is applied to the sheet material P. Examples of the post-processing device include a device that performs sheet reversing and conveying processing for reversing the sheet printed by the printer 20, feeding the sheet again to the printer 20, and causing print on both sides of the sheet material P, or processing of binding a plurality of sheets.

Figure 3:
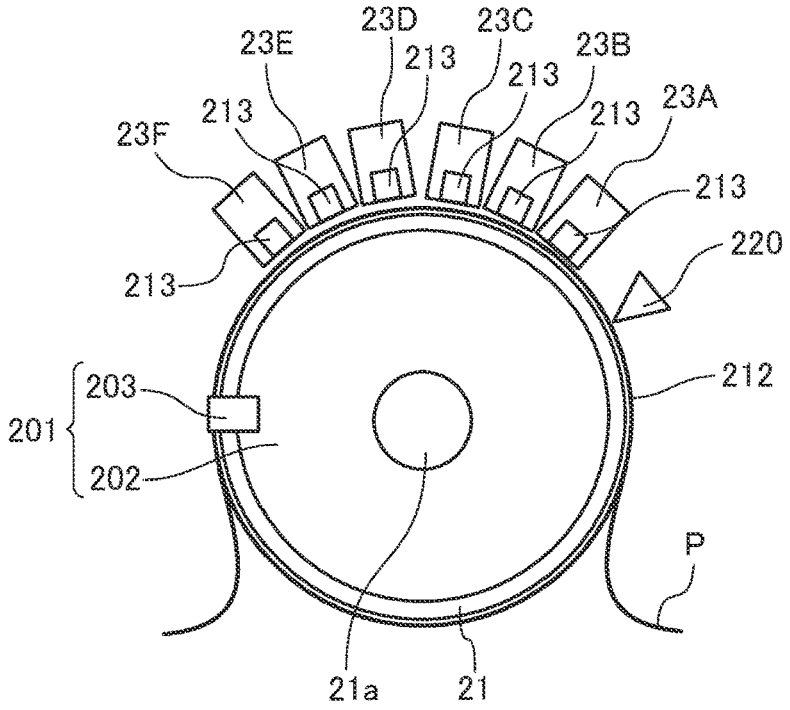
FIG. 3 is a front explanatory view around a conveying drum for explaining a portion related to detection for performing discharge timing control in the first embodiment.
Figure 4:
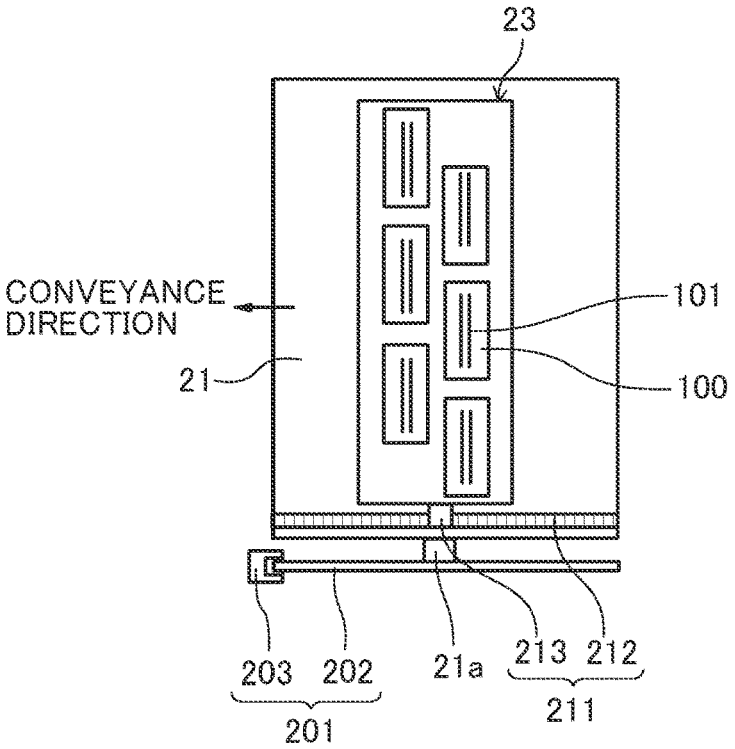
FIG. 4 is a plan explanatory view of the same.

Next, a portion related to detection for performing the discharge timing control in the present embodiment will be described referring to FIGS. 3 and 4. FIG. 3 is a front explanatory view around a conveying drum, and FIG. 4 is a plan explanatory view of the same. However, in FIG. 4, one discharge unit is illustrated for simplicity.

An encoder wheel 202 is provided on a shaft 21*a* of the conveying drum 21 and an encoder sensor 203 to read the encoder wheel 202 is arranged. The encoder wheel 202 and the encoder sensor 203 constitute the first encoder 201 as a first signal output device. The first encoder 201 is a rotary encoder, and outputs a first signal (output pulse) according to the rotation amount (rotational drive amount) of the conveying drum 21.

An encoder scale 212 is attached on a circumferential surface of the conveying drum 21 and an encoder sensor 213 to read the encoder scale 212 is arranged. The encoder scale 212 and the encoder sensor 213 constitute the second encoder 211 as a second signal output device. The second encoder 211 is a linear encoder and outputs a second signal (output pulse) corresponding to the movement amount of the circumferential surface of the conveying drum 21. The second signal is a signal correlated with the movement amount of the sheet material P on the circumferential surface of the conveying drum 21.

Here, the encoder sensor 213 included in the second encoder 211 is arranged in the vicinity of each of the plurality of discharge units 23. In the present embodiment, the encoder sensor 213 is attached to the base member 52 of the discharge units 23. Therefore, the encoder sensor 213 of each discharge unit 23 and the encoder scale 212 of the conveying drum 21 constitute each second encoder 211.

A sheet-material position sensor 220 as a sheet-material position detector to detect the tip end of the sheet material P is arranged on the upstream side in the conveyance direction of the discharge unit 23A on the most upstream side in the conveyance direction.

In this embodiment, the sheet-material position sensor 220 detects the tip end of the sheet material P. However, the sheet-material position sensor 220 may read a mark (registration mark) attached to the sheet material P. By adopting the configuration of reading the registration, it is possible to cope with a case of using not only a cut sheet material but also a continuous medium such as continuous paper.

Figure 5:
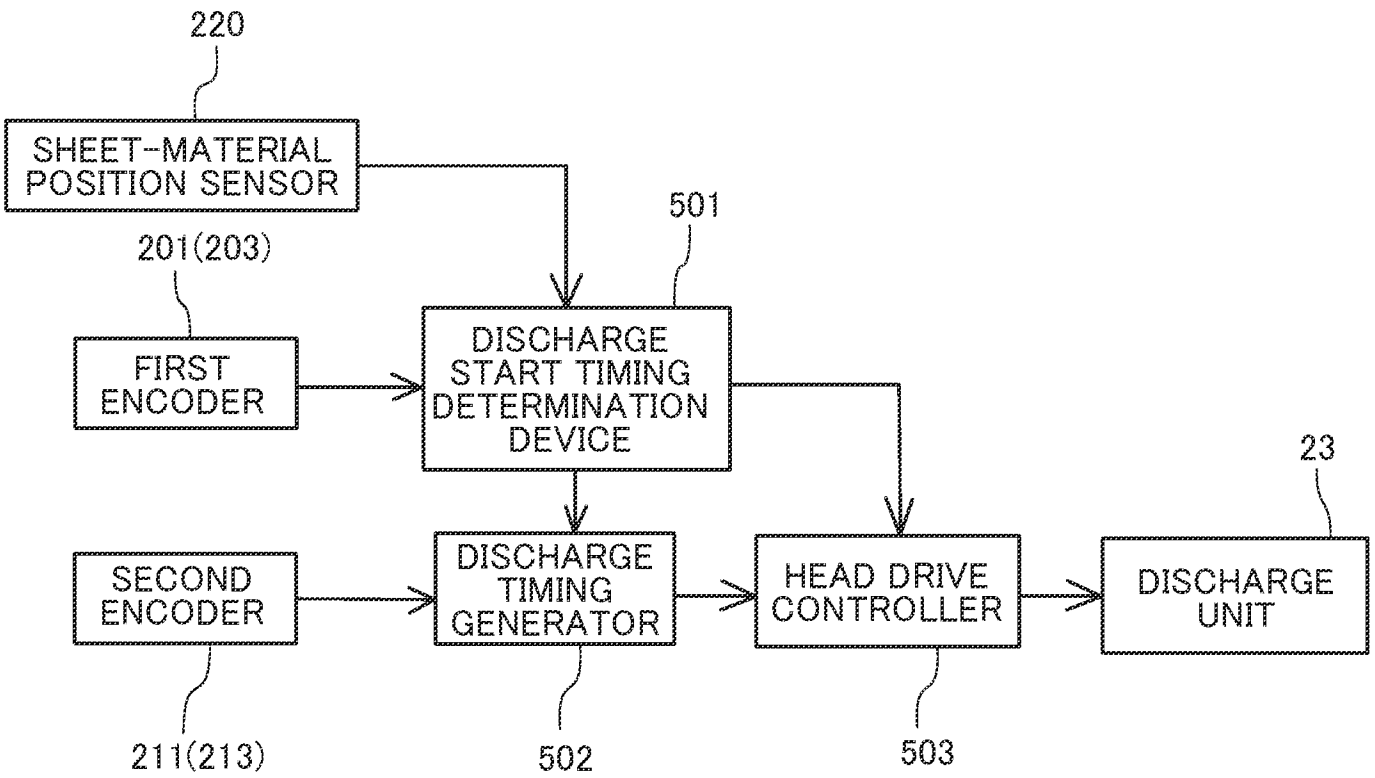
FIG. 5 is a block explanatory diagram for explaining a portion related to discharge timing control.

Next, a portion related to the discharge timing control will be described referring to a block explanatory diagram of FIG. 5.

A discharge start timing determination device 501 counts the output pulse which is the first signal from the first encoder 201 from the time when the detection result of the sheet-material position sensor 220 is in the state of detecting the tip end position of the sheet material P, to determine (decide) the discharge start timing.

A discharge timing generator 502 generates the discharge timing after the discharge at the discharge start timing determined by the discharge start timing determination device 501, on the basis of the output pulse which is the second signal of the second encoder 211.

A head drive controller 503 starts discharge from each discharge unit 23 at the discharge start timing determined by the discharge start timing determination device 501, and after the discharge starts, the head drive controller 503 causes the discharge unit 23 to discharge liquid at the discharge timing generated by the discharge timing generator 502.

Figure 6:
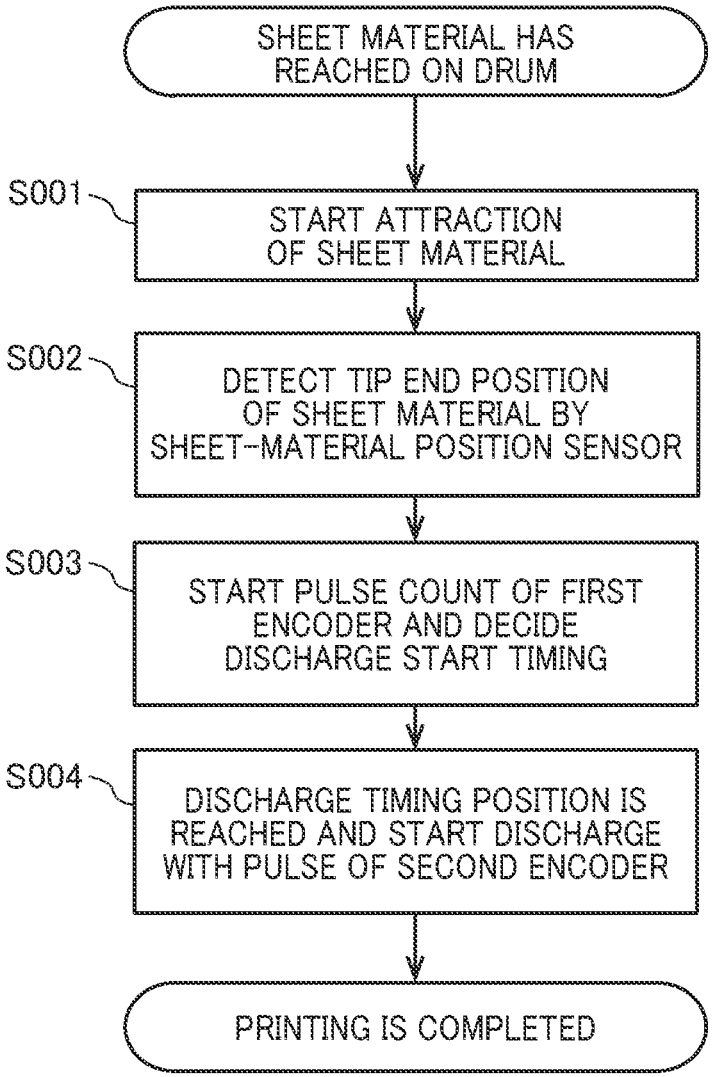
FIG. 6 is a flowchart for explaining discharge control.

Next, the discharge control will be described referring to the flowchart of FIG. 6.

As described above, when the sheet material P is transferred to the conveying drum 21 by the transfer cylinder 24, the attraction device 26 starts attraction of the sheet material P, and the sheet material P is conveyed by the rotation of the conveying drum 21 (step S001. Hereinafter, simply referred to as "S001").

Then, from the time when the tip end of the sheet material P is detected by the sheet-material position sensor 220 (S002), the output pulse of the first encoder 201 is counted, and when the count value reaches a predetermined count value, the discharge start timing for each color from each discharge unit 23 is decided (S003). As a result, discharge from each discharge unit 23 is started.

After the start of discharge, each time the discharge timing position is reached, the discharge timing is generated by the output pulse of the second encoder 211, and liquid is discharged from the discharge unit 23 to form an image on the sheet material P.

In this manner, the overlay accuracy for each color is controlled by the output of the first encoder 201. The interval and positional accuracy of the dots in the conveyance direction are controlled by the position of the actual sheet material P on the conveying drum 21 detected by the second encoder 211.

As a result, the discharge accuracy between the same colors, which is required to be high, can be defined by the actual position of the sheet material P on the conveying drum 21 obtained by the second encoder 211. At this time, the second encoder 211 detects the movement amount of the surface of the conveying drum 21, and it is possible to cancel errors due to the rotation accuracy of a conveying drum 21*n* and the accuracy of the parts of the conveying drum 21. Therefore, even when a high-precision encoder is not used as the first encoder, high landing position accuracy can be obtained, and the printing quality is improved.

Figure 7:
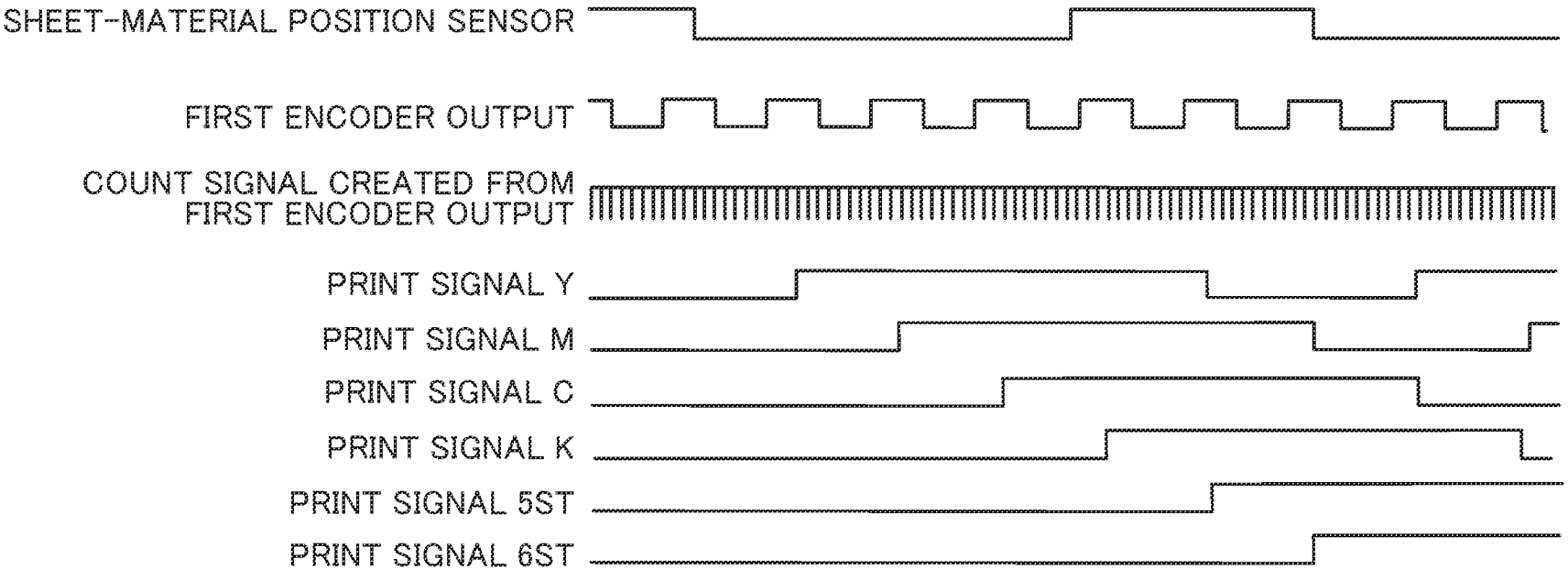
FIG. 7 is a timing chart for explaining decision of a discharge start timing using output of a first encoder.

Here, decision of the discharge start timing using output of the first encoder will be described referring to the timing chart of FIG. 7.

In the first example, upon detecting the falling edge of the output of the sheet-material position sensor 220, the count of the count signal obtained by multiplying the output of the first encoder 201 is started. Then, when the count number reaches a predetermined value matched with the physical distance of the discharge unit of each color, a print signal (discharge start timing signal) of each color is output. Here, although the output of the first encoder 201 is multiplied, when the multiplication processing is not performed, the first encoder 201 with high precision is provided on the axis of the drum of the conveying drum 21.

In the second example, a count signal obtained by multiplying the output of the first encoder 201 is generated, and until the falling edge of the sheet-material position sensor 220 (presence of paper) is detected, the pulse number of the count signal from the edge of the previous output of the first encoder 201 is counted.

When the falling edge of the output of the sheet-material position sensor 220 is detected, the count value of the count signal at that timing is stored, count by the edge of the output of the first encoder 201 is started, and when the count number of the output of the first encoder 201 reaches the predetermined value matched with the physical distance of the discharge unit 23 of each color, a print signal of each color is output after delay for the count number of the stored count signal.

As a result, the counter size can be suppressed smaller than in the first example.

In the present embodiment, after the discharge start timing signal for each color is output as described above, the discharge of the liquid from the head 100 of the discharge unit 23 is actually performed with the discharge timing signal generated with the output pulse of the second encoder 211.

Figure 8:
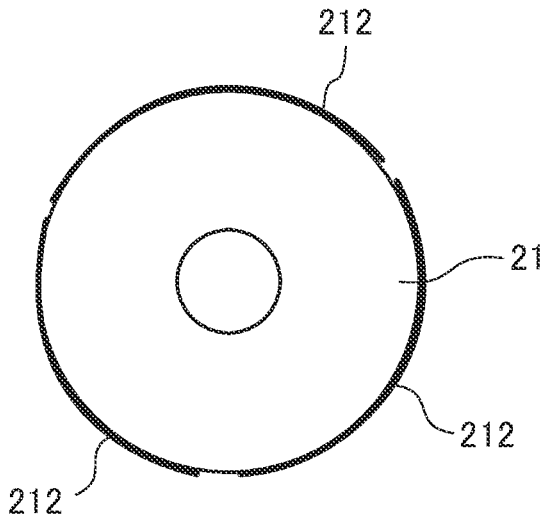
FIG. 8 is a side explanatory view of a conveying drum for explaining a second embodiment of the present invention.

Next, a second embodiment of the present invention will be described referring to FIG. 8. FIG. 8 is a side explanatory view of a conveying drum for explaining the second embodiment.

In the present embodiment, encoder scales 212 divided into plural are provided on the circumferential surface of the conveying drum 21. The number of divisions is the number of sheet materials P that can be carried at the same time.

This makes it possible to reduce the cost of the encoder scale which is generally expensive depending on the length.

Figure 9:
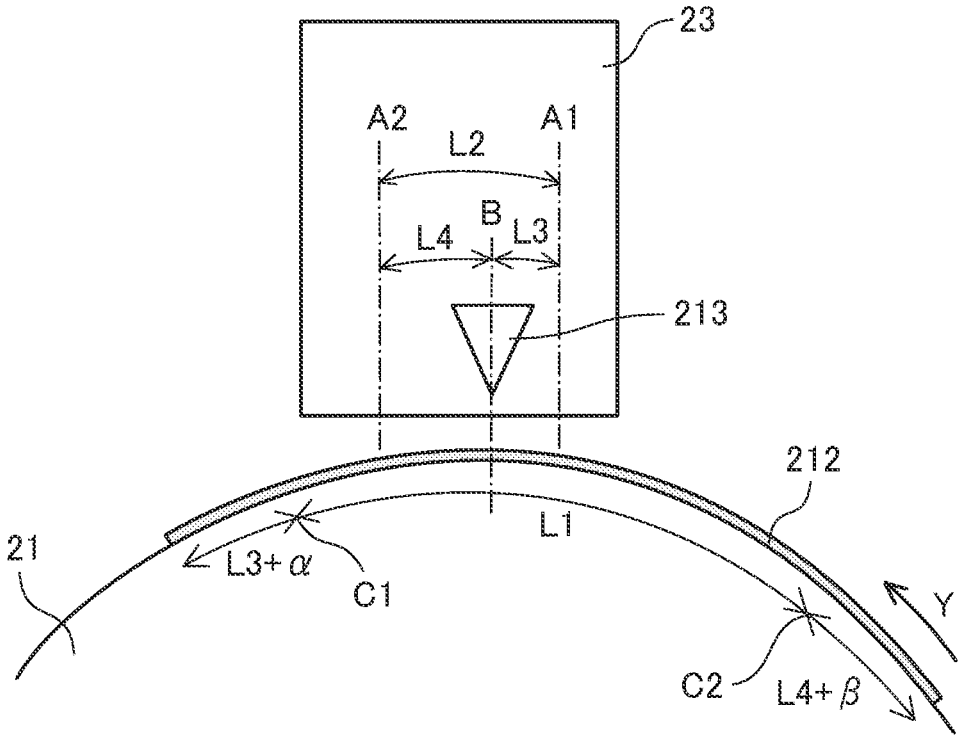
FIG. 9 is an enlarged explanatory view of a main portion for explaining an encoder scale in a third embodiment of the present invention.

Next, a third embodiment of the present invention will be described referring to FIG. 9. FIG. 9 is an enlarged explanatory view of a main portion for explaining an encoder scale in the third embodiment.

In the present invention, when the discharge unit 23 faces the sheet material P, it is necessary to adopt a configuration in which the second encoder 211 performs detection.

Therefore, as illustrated in FIG. 9, the length L of the encoder scale 212 is set to be longer than length obtained by summing the maximum sheet material length L1 and the length in the conveyance direction of the discharge region (image formation region) in the conveyance direction of the discharge unit 23, that is, the distance L2 between a discharge region upstream end A1 and a discharge region downstream end A2 (L>L1+L2).

The discharge region upstream end A1 here means the most upstream nozzle position of the discharge unit 23A and the discharge region downstream end A2 means the most downstream nozzle position of the discharge unit 23F.

Here, in the present embodiment, a reading position B1 of the encoder sensor 213 is on the downstream side of the discharge region upstream end A1 in a conveyance direction Y.

Therefore, in the conveyance direction Y, the tip end of the encoder scale 212 is located on the downstream side in the conveyance direction by the distance (L3+α) including the distance L3 between the reading position B1 of the encoder sensor 213 and the discharge region upstream end A1 with respect to a tip end carrying position C1 of the sheet material P, and a margin α of detection, that is, by the distance longer than the distance L3.

In the present embodiment, the discharge region downstream end A2 is located in the downstream side from the reading position B1 of the encoder sensor 213 in the conveyance direction Y.

Therefore, in the conveyance direction Y, the rear end of the encoder scale 212 is located on the upstream side in the conveyance direction by the distance (L4+β) including the distance L4 between the reading position B1 of the encoder sensor 213 and the discharge region downstream end A2 with respect to a rear end carrying position C2 of the sheet material P of the maximum length, and a margin β of detection, that is, by the distance longer than the distance L4.

Therefore, the total length of the encoder scale 212 is L+(L3+α)+(L4+≈).

With this configuration, when the liquid is discharged from the discharge unit 23, the second encoder 211 outputs the second signal (output pulse), so that it is possible to reliably generate the discharge timing signal.

Figure 10:
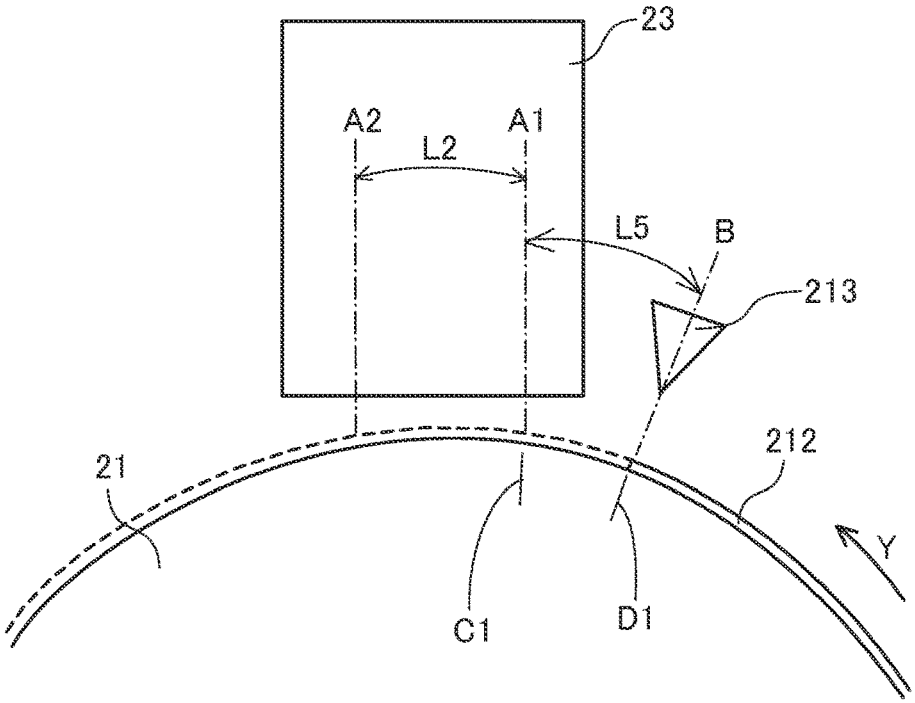
FIG. 10 is an enlarged explanatory view of a main portion for explaining an encoder scale in a fourth embodiment of the present invention.

Next, a fourth embodiment of the present invention will be described referring to FIG. 10. FIG. 10 is an enlarged explanatory view of a main portion for explaining an encoder scale in the fourth embodiment.

In the present embodiment, a reading position B1 of the encoder sensor 213 is on the upstream side from the discharge region upstream end A1 in a conveyance direction Y. Therefore, the encoder scale 212 may be read by the encoder sensor 213 when the tip end of the sheet material P is located at the discharge region upstream end A1.

Therefore, when the tip end carrying position C1 of the sheet material P is the discharge region upstream end A1, the tip end of the encoder scale 212 is located on the downstream side from the position D1 in the upstream side in the conveyance direction by the distance L5 between the reading position B and the discharge region upstream end A1 with respect to the tip end carrying position C1 of the sheet material P in the conveyance direction Y. In this case, the tip end of the encoder scale 212 is not particularly limited as long as the tip end is on the downstream side from the position D1 as indicated by the broken line.

The rear end position of the encoder scale 212 according to the present embodiment is located on the upstream side in the conveyance direction by the distance (L5+L2+γ) together with the description in the third embodiment.

Figure 11:
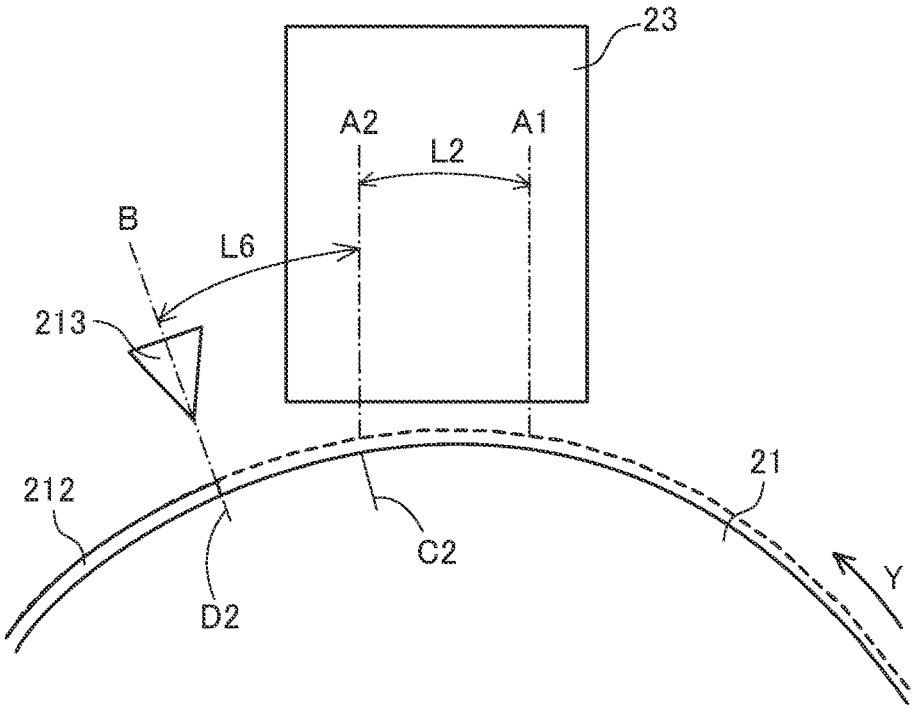
FIG. 11 is an enlarged explanatory view of a main portion for explaining an encoder scale in a fifth embodiment of the present invention.

Next, a fifth embodiment of the present invention will be described referring to FIG. 11. FIG. 11 is an enlarged explanatory view of a main portion for explaining an encoder scale in the fifth embodiment.

In the present embodiment, a reading position B1 of the encoder sensor 213 is on the downstream side from the discharge region downstream end A2 in the conveyance direction Y. Therefore, the encoder scale 212 may be read by the encoder sensor 213 when the rear end of the sheet material P is located at the discharge region downstream end A2.

Therefore, when the rear end carrying position C2 of the sheet material P is the discharge region downstream end A2, the rear end of the encoder scale 212 is located on the upstream side from the position D2 in the downstream side in the conveyance direction by the distance L6 between the reading position B and the discharge region downstream end A2 with respect to the rear end carrying position C2 of the sheet material P in the conveyance direction Y. In this case, the rear end of the encoder scale 212 is not particularly limited as long as the rear end is on the upstream side from the position D2 as indicated by the broken line.

The tip end position of the encoder scale 212 according to the present embodiment is located on the downstream side in the conveyance direction by the distance (L6+L2+η) together with the description in the third embodiment.

In the third to fifth embodiments described above, when the number of nozzle rows is only one, since the upstream end A1 and the downstream end A2 of the discharge region coincide with each other, the tip end position and the rear end position of the encoder scale 212 may be set by combination of the third to fifth embodiments accordingly.

In the above-described embodiments, the rotator is a conveying drum. However, the present invention can be similarly applied to the case of using an endless belt.

In the above-described embodiments, the second signal output device is a linear encoder. However, it is also possible to include a device to measure the movement amount of the surface of the sheet material carried on the circumferential surface of the rotator, and output a signal corresponding to the movement amount (including speed detecting device).

In the present application, the discharged liquid may be any liquid having viscosity and surface tension with which discharge can be performed from the head, and is not particularly limited. However, it is preferable that the liquid has viscosity of 30 mPa·s or less at ordinary temperature and ordinary pressure or by heating and cooling. More specifically, the liquid is solution, suspension, emulsion, or the like including a solvent such as water or an organic solvent, a colorant such as a dye or a pigment, a functionalizing material such as a polymerizable compound, a resin or a surfactant, a biocompatible material such as DNA, amino acid, protein, or calcium, an edible material such as a natural pigment, and the like, which can be used, for example, as formation liquid of an inkjet ink, a surface treatment liquid, constituent elements of an electronic element or a light-emitting element, and an electronic circuit resist pattern, three-dimensional modeling material solution, or the like.

Examples of an energy generation source that discharges liquid include one that uses a thermal actuator using an electrothermal transducer such as a piezoelectric actuator (laminated type piezoelectric element and thin film type piezoelectric element), or a heating resistor, an electrostatic actuator including a diaphragm and a counter electrode, and the like.

Examples of the "liquid discharge apparatus" include an apparatus that includes a liquid discharge head, and drives the liquid discharge head to discharge liquid. Examples of the liquid discharge apparatus include not only an apparatus that can discharge liquid to a liquid adherable material but also an apparatus that discharges liquid towards air or liquid.

This "liquid discharge apparatus" may include a means related to feeding of a liquid adherable material, conveying, and sheet ejection, a preprocessing device, a post-processing device, or the like.

For example, there is an image forming apparatus that discharges ink to form an image on paper as a "liquid discharge apparatus".

The "liquid discharge apparatus" is not limited to one with which significant images such as letters, graphics, or the like is visualized by discharged liquid. For example, one that forms a pattern or the like that itself has no meaning, and one that molds a three-dimensional image are included.

The above-mentioned "liquid adherable material" means one to which liquid can be adhered at least temporarily, adhered and fastened, adhered and permeated, or the like. Specific examples include a recording medium such as paper, a recording sheet, recording paper, a film, or a cloth, an electronic component such as an electronic substrate or a piezoelectric element, and a medium such as a powder material layer (powder layer), organ model, or an inspection cell, and unless specifically limited, include everything to which liquid adheres.

The material of above-mentioned "liquid adherable material" may be any material such as paper, thread, fiber, cloth, leather, metal, plastic, glass, wood, ceramics or the like as long as liquid can adhere to the material even temporarily.

As the "liquid discharge apparatus", there is an apparatus in which a liquid discharge head and a liquid adherable material move relative to each other, but this is not a limitation. Specific examples include a serial type apparatus that moves the liquid discharge head, a line type apparatus that does not move the liquid discharge head, or the like.

As a "liquid discharge apparatus", there are also a treatment liquid application apparatus that discharges treatment liquid onto paper in order to apply the treatment liquid to the surface of the sheet for the purpose of modifying the surface of the paper or the like, an injection granulation apparatus that granulates fine particles of a raw material by injecting a composition liquid in which raw materials are dispersed in a solution, through a nozzle, and the like.

In the terms of the present application, image formation, recording, typing, imaging, printing, molding and the like are all synonymous.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid discharge apparatus comprising:

a cylindrical rotator to carry a sheet material on a circumferential surface of the cylindrical rotator and convey the sheet material;

a liquid discharger facing the circumferential surface to discharge liquid onto the sheet material;

a sheet-material position detector to detect a position of the sheet material;

a first signal output device to output a first signal corresponding to a rotation amount of the cylindrical rotator;

a second signal output device to output a second signal correlated with a movement amount of the sheet material on the circumferential surface of the cylindrical rotator, wherein the second signal output device comprises an encoder scale provided on the circumferential surface of the cylindrical rotator, and an encoder sensor arranged in a vicinity of the liquid discharger and reading the encoder scale, and wherein $L>L1+L2$ is satisfied, where L is a length of the encoder scale, L1 is a maximum length of the sheet material that can be carried, and L2 is a length of a discharge region of the liquid discharger, in a conveyance direction; and circuitry to determine a discharge start timing of the liquid discharger from a detection result of the sheet-material position detector and the first signal, and generate a discharge timing of the liquid discharger from the second signal.

2. The liquid discharge apparatus according to claim 1, further comprising a plurality of liquid dischargers including the liquid discharger, wherein the encoder sensor is arranged in vicinity of each of the liquid dischargers.

3. The liquid discharge apparatus according to claim 1, further comprising a plurality of encoder scales including the encoder scale, wherein the plurality of encoder scales is arranged on the circumferential surface of the cylindrical rotator.

4. The liquid discharge apparatus according to claim 1, wherein a reading position of the encoder sensor is on an upstream side from a discharge region upstream end of the liquid discharger in a conveyance direction, and wherein a tip end of the encoder scale is located on a downstream side from a position on the upstream side in the conveyance direction by a distance between the reading position and the discharge region upstream end, with respect to a tip end carrying position of the sheet material.

5. The liquid discharge apparatus according to claim 1, wherein a reading position of the encoder sensor is on a downstream side from a discharge region upstream end of the liquid discharger in a conveyance direction, and wherein a tip end of the encoder scale is located on a downstream side in the conveyance direction by a distance longer than a distance between the reading position and the discharge region upstream end, with respect to a tip end carrying position of the sheet material.

6. The liquid discharge apparatus according to claim 1, wherein the first signal output device comprises an encoder wheel provided on a shaft of the cylindrical rotator, and an encoder sensor to read the encoder wheel.

7. The liquid discharge apparatus according to claim 1, wherein the sheet-material position detector detects a tip end of the sheet material.

8. The liquid discharge apparatus according to claim 1, wherein the sheet-material position detector detects a mark provided on the sheet material.

9. A liquid discharge apparatus comprising:

a cylindrical rotator to carry a sheet material on a circumferential surface of the cylindrical rotator and convey the sheet material;

a liquid discharger facing the circumferential surface to discharge liquid onto the sheet material;

a sheet-material position detector to detect a position of the sheet material;

a first signal output device to output a first signal corresponding to a rotation amount of the cylindrical rotator;

a second signal output device to output a second signal correlated with a movement amount of the sheet material on the circumferential surface of the cylindrical rotator, wherein the second signal output device comprises an encoder scale provided on the circumferential surface of the cylindrical rotator, and an encoder sensor arranged in a vicinity of the liquid discharger and reading the encoder scale, wherein a reading position of the encoder sensor is on an upstream side from a discharge region upstream end of the liquid discharger in a conveyance direction, and wherein a tip end of the encoder scale is located on a downstream side from a position on the upstream side in the conveyance direction by a distance between the reading position and the discharge region upstream end, with respect to a tip end carrying position of the sheet material; and circuitry to determine a discharge start timing of the liquid discharger from a detection result of the sheet-material position detector and the first signal, and generate a discharge timing of the liquid discharger from the second signal.

10. The liquid discharge apparatus according to claim 9, further comprising a plurality of liquid dischargers including the liquid discharger, wherein the encoder sensor is arranged in vicinity of each of the liquid dischargers.

11. The liquid discharge apparatus according to claim 9, further comprising a plurality of encoder scales including the encoder scale, wherein the plurality of encoder scales is arranged on the circumferential surface of the cylindrical rotator.

12. The liquid discharge apparatus according to claim 9, wherein a reading position of the encoder sensor is on an upstream side from a discharge region downstream end of the liquid discharger in the conveyance direction, and wherein a rear end of the encoder scale is located on an upstream side in the conveyance direction by a distance longer than the distance between the reading position and the discharge region downstream end, with respect to a rear end carrying position of the sheet material.

13. The liquid discharge apparatus according to claim 9, wherein the first signal output device comprises an encoder wheel provided on a shaft of the cylindrical rotator, and an encoder sensor to read the encoder wheel.

14. The liquid discharge apparatus according to claim 9, wherein the sheet-material position detector detects a tip end of the sheet material.

15. The liquid discharge apparatus according to claim 9, wherein the sheet-material position detector detects a mark provided on the sheet material.

16. A liquid discharge apparatus comprising:

a cylindrical rotator to carry a sheet material on a circumferential surface of the cylindrical rotator and convey the sheet material;

a liquid discharger facing the circumferential surface to discharge liquid onto the sheet material;

a sheet-material position detector to detect a position of the sheet material;

a first signal output device to output a first signal corresponding to a rotation amount of the cylindrical rotator;

a second signal output device to output a second signal correlated with a movement amount of the sheet material on the circumferential surface of the cylindrical rotator, wherein the second signal output device comprises an encoder scale provided on the circumferential surface of the cylindrical rotator, and an encoder sensor arranged in a vicinity of the liquid discharger and reading the encoder scale, wherein a reading position of the encoder sensor is on a downstream side from a discharge region upstream end of the liquid discharger in a conveyance direction, and wherein a tip end of the encoder scale is located on a downstream side in the conveyance direction by a distance longer than a distance between the reading position and the discharge region upstream end, with respect to a tip end carrying position of the sheet material; and circuitry to determine a discharge start timing of the liquid discharger from a detection result of the sheet-material position detector and the first signal, and generate a discharge timing of the liquid discharger from the second signal.

17. The liquid discharge apparatus according to claim 16, further comprising a plurality of liquid dischargers including the liquid discharger, wherein the encoder sensor is arranged in vicinity of each of the liquid dischargers.

18. The liquid discharge apparatus according to claim 16, further comprising a plurality of encoder scales including the encoder scale, wherein the plurality of encoder scales is arranged on the circumferential surface of the cylindrical rotator.

19. The liquid discharge apparatus according to claim 16, wherein a reading position of the encoder sensor is on a downstream side from a discharge region downstream end of the liquid discharger in the conveyance direction, and wherein a rear end of the encoder scale is located on an upstream side from a position on a downstream side in the conveyance direction by a distance between the reading position and the discharge region downstream end, with respect to a rear end carrying position of the sheet material.

20. The liquid discharge apparatus according to claim 16, wherein the first signal output device comprises an encoder wheel provided on a shaft of the cylindrical rotator, and an encoder sensor to read the encoder wheel.

* * * * *